United States Patent [19]

Kiiskilä et al.

[11] Patent Number: 4,929,307

[45] Date of Patent: May 29, 1990

[54] METHOD OF DECREASING BLACK LIQUOR VISCOSITY

[75] Inventors: Erkki J. Kiiskilä, Karhula; Nils E. Virkola, Helsinki, both of Finland

[73] Assignee: A. Ahlstrom Corporation, Karhula, Finland

[21] Appl. No.: 312,424

[22] Filed: Feb. 17, 1989

Related U.S. Application Data

[63] Continuation of Ser. No. 110,710, filed as PCT FI86/00133 on Nov. 25, 1985, published as WO87/03315 on June 4, 1987, abandoned.

[30] Foreign Application Priority Data

Nov. 29, 1985 [FI] Finland ..... 85 4732

[51] Int. Cl.[5] ..... B01D 1/26; D21C 11/10

[52] U.S. Cl. ..... 159/47.3; 159/DIG. 8; 162/29; 162/30.11

[58] Field of Search ..... 159/DIG. 8, 47.3; 203/32, 71; 162/29, 30.1, 30.11, 31; 423/DIG. 3

[56] References Cited

U.S. PATENT DOCUMENTS

| | | | |
|---|---|---|---|
| 1,719,130 | 7/1929 | Richter et al. | 159/47.3 |
| 2,754,897 | 7/1956 | Ramen | 159/47.3 |
| 2,891,843 | 6/1959 | Moxness | 159/47.3 |
| 3,026,240 | 3/1962 | Matty | 159/47.3 |
| 3,092,535 | 6/1963 | Tomlinson, II | 159/47.3 |
| 3,451,765 | 6/1969 | Schleindl | 423/182 |
| 3,888,726 | 6/1975 | Hultman | 162/49 |
| 3,932,207 | 1/1976 | Fogarassy | 162/19 |
| 4,384,921 | 5/1983 | Pihlajamaki et al. | 162/72 |
| 4,530,737 | 7/1985 | / stman | 159/47.3 |
| 4,533,433 | 8/1985 | Petterson | 162/30.11 |
| 4,690,731 | 9/1987 | Hartler et al. | 162/45 |
| 4,755,258 | 7/1988 | Ryham | 159/47.3 |

FOREIGN PATENT DOCUMENTS

| | | | |
|---|---|---|---|
| 1097465 | 3/1981 | Canada | 162/47 |
| 1200055 | 2/1986 | Canada | 159/47.3 |
| 897513 | 10/1953 | Fed. Rep. of Germany . | |
| 2506970 | 7/1980 | Fed. Rep. of Germany . | |
| 0066035 | 4/1984 | Finland . | |
| 0030052 | 2/1918 | Norway . | |
| 0957120 | 5/1964 | United Kingdom | 203/10 |

OTHER PUBLICATIONS

Bennington, C. P. J. "The Effect of Temperature on Drop Size of Black Liquor Sprays".

Small, James D. "Thermal Stability of Kraft Black Liquor Viscosity at Elevated Temperatures".

*Primary Examiner*—Virginia Manahoran

*Attorney, Agent, or Firm*—Cohen,Pontani & Lieberman

[57] ABSTRACT

A method of decreasing the viscosity and improving the evaporability of sulfate black liquor from the cellulose cook includes raising the temperature of the black liquor above the cooking temperature so as to split the macro-molecular lignin fraction contained in the liquor. The temperature of the black liquor is maintained at the raised level for 1 to 60 minutes, preferably for 1 to 5 minutes.

7 Claims, 1 Drawing Sheet

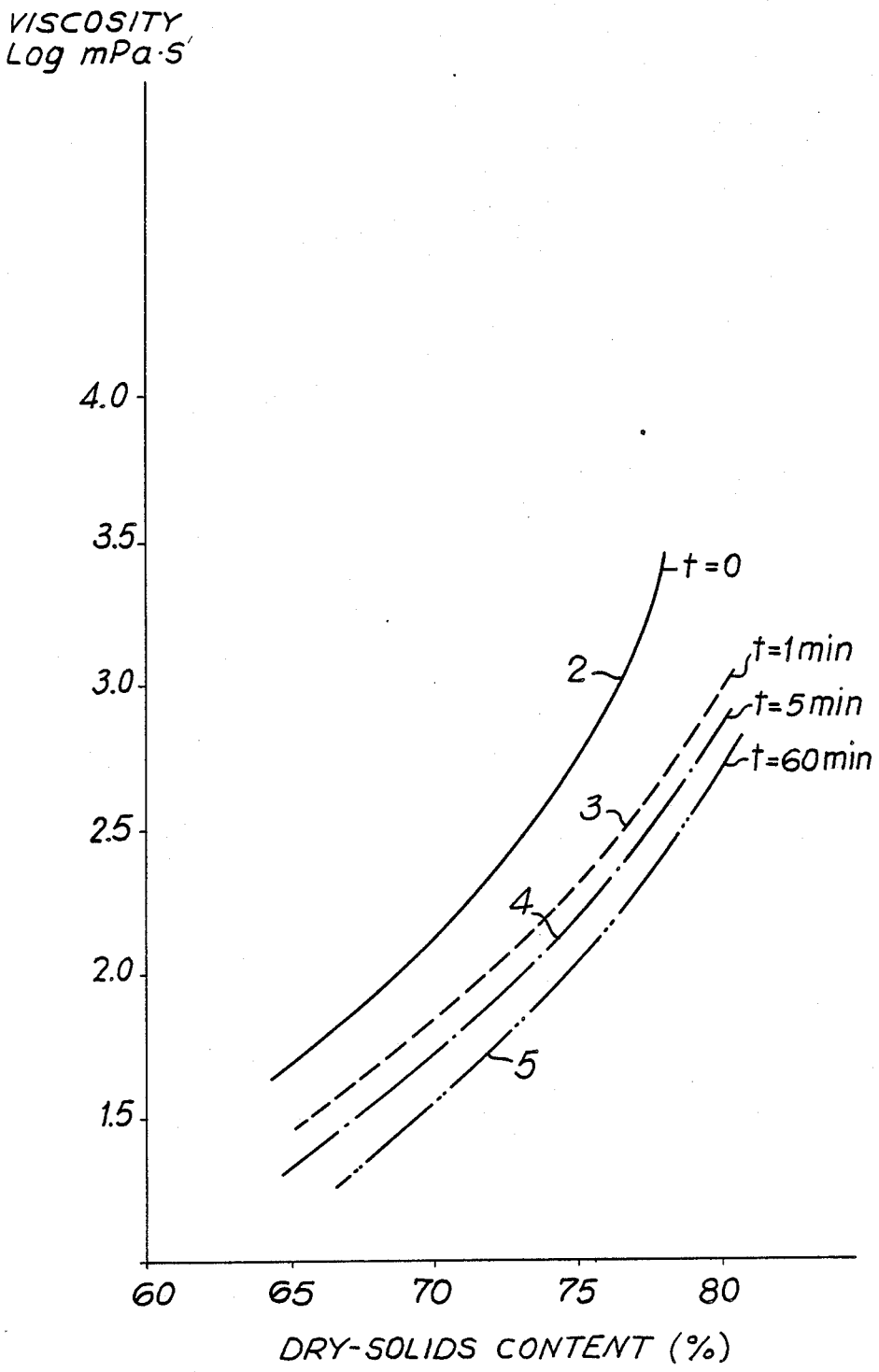
VISCOSITY
Log mPa·S
4.0
3.5
3.0
2.5
2.0
1.5
t=0
t=1min
t=5min
t=60min
2
3
4
5
60
65
70
75
80
DRY-SOLIDS CONTENT (%)

METHOD OF DECREASING BLACK LIQUOR VISCOSITY

This is a continuation of U.S. application Ser No. 110,710, filed as PCT FI86/00133 on Nov. 26, 1986, published as WO87/03315 on June 4, 1987, now abandoned.

TECHNICAL FIELD

The invention relates to a method of reducing the viscosity and of improving the evaporability of black liquor from a cellulose cook.

When evaporating sulphate black liquor to a high (60–75%) dry-solids content, the viscosity of the liquor increases rapidly. At the same time its evaporability decreases remarkably as the black liquor sticks to the heat surfaces thus impairing the heat transfer from the heat surfaces to the black liquor, which results in a decrease in the efficiency of the evaporator. It may also result in overheating of the heat transfer surfaces. With high dry-solids contents the flow velocity, for example, on the heat transfer surfaces of a falling-film evaporator decreases and the end of the sticky black liquor prevent the flow through the evaporator.

It is advantageous to evaporate the liquor so as to have a high dry-solids content as possible for further treatment, the effective combustion value of the waste liquor is then higher than that of a wet liquor and the volume of the steam generated by the recovery boiler is respectively greater.

BACKGROUND ART

Swedish patent specification no. SE 8400904 discloses a method of decreasing the viscosity of black liquor after the evaporator immediately before the recovery boiler by oxidizing the liquor whereafter liquor of a higher dry-solids content can be introduced into the boiler. The oxidation reaction which is achieved by mixing warm oxidizing gas (such as air) in the liquor raises the temperature of the liquor and makes it more fluent or flowable. The method requires quite a complex apparatus for distributing the oxidizing gas evenly in the liquid. The method is primarily effected immediately before the recovery boiler where a rise in the temperature of the liquid is achieved and pumping facilitated. If the method is applied in the process before the final evaporation, the carbon dioxide and organic acids produced in the oxidizing reaction reduce the pH of the liquor which may result in condensation of the lignin and cause considerable depositions on the heat transfer surfaces.

It is a known fact that the viscosity of black liquor depends on the amount of the macro-molecular lignin in the liquor. In prior art methods the viscosity has been decreased by removing the macro-molecular fraction.

Finnish patent specification no. 66035 discloses a method of removing organic material containing a macro-molecular fraction from the effluent of a cellulose cook. According to this method the macro-molecular fraction is removed by ultra-filtering or precipitating. Precipitation is performed by oxidizing the effluent which significantly reduces the viscosity of the effluent.

The ultrafiltering method, by which the macro-molecular fraction is separated from the effluent, requires, however, sizable and expensive apparatus. A complex apparatus is required for the precipitation. Addition of chemicals in the precipitation phase affects the chemical balance of the whole system. In continuous operation, separation of the chemicals is problematic and cannot easily be controlled or changed.

DISCLOSURE OF INVENTION

The object of the present invention is to eliminate or minimize the above disadvantages and to provide a method for decreasing the viscosity of black liquor before final evaporation without separation of the different macro-molecular lignin fractions of the black liquor which would then have to be treated separately. As is known, at this stage the black liquor contains no or substantially no fibrous material.

The main characteristic feature of the method of the present invention is that the temperature of the black liquor is raised above the cooking temperature, preferably up to 170°–190° C., in order to split the macro-molecular lignin fractions.

The method according to the invention provides for a controlled reduction of the viscosity of the whole black liquor amount.

without the problematic separation of different fractions without extensive investments both in batch and continuous cooking.

With the method according to the present invention the capacity of an existing evaporation plant can be improved or in a new evaporation plant, the heat surface of the concentrator can be dimensioned smaller. Further, the final dry-solids content of the liquor can be increased without any substantial changes in the pressurization of the apparatus, which improves the heat economy of the combustion. When the flow resistance decreases the pumpability of the liquor improves and the power consumption of the pump decreases.

When studying the absolute amounts of lignin fractions of different size as a function of cooking parameters in a soda cook and in a sulfate cook the following conclusions can be reached:

in a soda cook the absolute amount of macro-molecular lignin increases at the beginning and after that maintains a constant level in a sulfate cook the amount of macro-molecular lignin increases at the beginning and reached the maximum after which the amount gradually decreases as the sulfide splits the lignin as shown in the following table.

| Sulfidity | Cooking time | M > 10000 | | M > 5000 | |
|---|---|---|---|---|---|
| % | min | % g/kg | dry solids | % g/kg | dry solids |
| 35 | 10 | 3 | 6,4 | 11 | 23,4 |
| 35 | 50 | 9 | 30,0 | 20 | 66,7 |
| 35 | 110 | 9 | 32,1 | 22 | 78,4 |
| 35 | 170 | 7 | 25,1 | 22 | 78,8 |
| 25 | 140 | 12 | 41,1 | 29 | 96,0 |
| 25 | 170 | 10 | 34,5 | 22 | 75,9 |
| 0 | 10 | 7 | 9,6 | 18 | 24,7 |
| 0 | 110 | 14 | 40,2 | 32 | 91,9 |
| 0 | 170 | 17 | 52,5 | 33 | 101,8 |

When the sulfidity is 35% the macro-molecular fraction (M>10000) 25,1 g/kg dry solids has decreased after a cooking time of 170 min; after 110 min the fraction was 32,1 g/kg dry solids. When the sulfidity is 25% the amount of the macro-molecular fraction has decreased with the time. When the sulfidity is zero no splitting of molecules can be seen. Thus, in order to secure good results, oxidation has to be prevented to preserve the sulfur in the sulfide state.

The higher the sulfidity of the cook the more intensive is the splitting. In normal cooking in the sulfidity range of 20–35% the remaining sulfide volume is adequate for the splitting. A reducing agent such as sulfur or polysulfide can in some cases be added to intensify the splitting.

It was surprisingly found out that raising the temperature above the normal cooking temperature, to 170°–190° C., accelerates the splitting of the macromolecular lignin fraction to the extent that only 1–5 minutes in a raised temperature is adequate to cause splitting and a decrease in the viscosity. It was also found out that compounds of calcium and lignin causing deposition in the evaporator are dispersed during the heat treatment.

As described above, the viscosity can be decreased in the black liquor itself without addition of chemicals or separation either during the cooking or the evaporation process by simple pressure heating. The temerature can be raised also in a separate circulation loop connected to the cooking process in continuous cooking in particular.

In each case the most economical heating method is chosen, for instance, direct or indirect steam heating or electric heating.

BRIEF DESCRIPTION OF DRAWING

The FIGURE indicates the effect of heat treatment on black liquor viscosity. Black liquor samples having a dry-solids content of 65%, 70%, 75% and 80% were treated at 190° C. Viscosity was measured before the treatment, after 1 min, 5 min and 60 min. For instance, after a treatment of 60 min, the viscosity of the liquor having a dry-solids content of 70–73% had decreased to the same level as the viscosity of an untreated liquor having a dry-solids content of 65% which is the level of normal combustion liquid.

MODE FOR CARRYING OUT THE INVENTION

The effect of further heating of mill liquor on the viscosity of the liquor is indicated by the following measurement results. Also the effect of $Na_2S$ or NaOH addition has been considered. The material tested was black liquor from a Kamyr-digestion having a dry-solids content of 71%.

| Chemical added Untreated liquor | Heating min. | Temperature °C. | Viscosity mPas 200 |
|---|---|---|---|
| — | 1 | 190 | 78 |
| — | 60 | 190 | 40 |
| $Na_2S$ | 60 | 120 | 158 |
| $Na_2S$ | 60 | 190 | 32 |

-continued

| Chemical added Untreated liquor | Heating min. | Temperature °C. | Viscosity mPas 200 |
|---|---|---|---|
| NaOH | 20 | 190 | 63 |
| NaOH | 60 | 190 | 52 |

The effect of heat treatment on the viscosity is thus obvious. A treatment at 120° C. decreases viscosity but not even nearly as efficiently as a treatment at 190° C. A heat treatment of only one minute at 190° C. decreases the viscosity from 200 mPas to 78 mPas. Addition of $Na_2S$ seems to have a slight decreasing effect on the viscosity, addition of NaOH on the other hand no effect at all.

INDUSTRIAL APPLICABILITY

The present invention thus provides a method for decreasing the viscosity in order to improve the evaporability and liquor transfer. The invention can be modified within the scope of protection defined by the patent claims.

We claim:

1. A method for decreasing the viscosity and improving the evaporability of sulfate black liquor containing different macro-molecular lignin fractions and substantially no fibrous material from a cellulose cook being cooked in a digester at a cooking temperature, consisting essentially of:

withdrawing said sulfate black liquor from said digester;

raising the temperature by pressure heating said sulfate black liquor to a temperature above the cooking temperature prior to final evaporation thereof without separating said different fractions;

maintaining said black liquor at said raised temperature for 1–60 minutes so as to split the macro-molecular lignin fractions contained in said liquor; and thereafter evaporating said black liquor.

2. The method according to claim 1, wherein said pressure heating step is performed immediately after the cook.

3. The method as claimed in claim 1, wherein said pressure heating step of said black liquor is performed immediately before the final evaporation thereof.

4. The method according to claim 1, additionally comprising adding a reducing agent to said black liquor so as to accelerate the splitting of the macro-molecular lignin fraction contained in said liquor.

5. The method according to claim 4, wherein said reducing agent is sulphur or polysulfide.

6. The method according to claim 1, wherein said sulfate black liquor is pressure heated to a temperature between 170° C. and 190° C.

7. The method according to claim 1, wherein said raised temperature is maintained for 1 to 5 minutes.

* * * * *